US005499759A

United States Patent [19]

Richards

[11] Patent Number: 5,499,759

[45] Date of Patent: Mar. 19, 1996

[54] DOWEL BOARD BOW FOLDING DEVICES

[76] Inventor: Tammy M. Richards, 3135 Elizabeth, Canon City, Colo. 81212

[21] Appl. No.: 306,419

[22] Filed: Sep. 15, 1994

[51] Int. Cl.[6] ..... A41H 43/00

[52] U.S. Cl. ..... 223/46; 28/147

[58] Field of Search ..... 223/46, 44; 28/147, 28/149, 150; 428/4, 5

[56] References Cited

U.S. PATENT DOCUMENTS

| | | | |
|---|---|---|---|
| 2,666,249 | 1/1954 | Ruiz et al. | 223/46 |
| 2,763,080 | 9/1956 | Welch | 223/46 |
| 2,966,759 | 1/1961 | Robertson | 223/46 |
| 3,044,670 | 7/1962 | Barefoot | 223/46 |
| 3,286,888 | 11/1966 | Cuttler et al. | 223/46 |
| 3,377,674 | 4/1968 | Brassan et al. | 28/147 |
| 4,528,217 | 7/1985 | Spathis et al. | 223/46 |
| 5,356,056 | 10/1994 | Teuten | 223/44 |

*Primary Examiner*—Amy B. Vanatta

[57] ABSTRACT

A dowel board bow folding device comprising: a base board formed in a planar generally rectangular configuration, the upper surface of the board having a plurality of bore holes, a large central bore hole being positioned adjacent to a side edge of the board, the board having a plurality of bore holes positioned at either side of the central bore, each set of bore holes being positioned in an angled orientation away from the central bore hole; and a plurality of generally cylindrical shaped dowels, the dowels including a central dowel having a larger diameter than the plurality of side dowels, the central dowel adapted to be positioned in the central bore hole of the base board, the side dowels being of equal size, each side dowel adapted to be positioned in a side bore hole in the operative orientation.

2 Claims, 4 Drawing Sheets

DOWEL BOARD BOW FOLDING DEVICES

BACKGROUND OF THE INVENTION

1. Field of the Invention

The present invention relates to dowel board bow folding devices and more particularly pertains to fashioning bows of varying shapes and sizes by wrapping material around one or more dowels of the device.

2. Description of the Prior Art

The use of bow forming apparatuses is known in the prior art. More specifically, bow forming apparatuses heretofore devised and utilized for the purpose of forming various types of bows are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,637,455 to Pearson prefabricated bow forms.

U.S. Pat. No. 4,410,113 to Palombo discloses a bow forming apparatus.

U.S. Pat. No. 4,651,908 to Ford discloses a bow making form.

U.S. Pat. No. 4,714,182 to Hecht discloses a method and apparatus for making bows.

Lastly, U.S. Pat. No. 3,428,227 to Cavoli discloses a bow frame.

In this respect, the dowel board bow folding devices according to the present invention substantially depart from the conventional concepts and designs of the prior art, and in doing so provides an apparatus primarily developed for the purpose of fashioning bows of varying shapes and sizes by wrapping material around one or more dowels of the device.

Therefore, it can be appreciated that there exists a continuing need for new and improved dowel board bow folding devices which can be used for fashioning bows of varying shapes and sizes by wrapping material around one or more dowels of the device. In this regard, the present invention substantially fulfills this need.

SUMMARY OF THE INVENTION

In view of the foregoing disadvantages inherent in the known types of bow forming apparatuses now present in the prior art, the present invention provides improved dowel board bow folding devices. As such, the general purpose of the present invention, which will be described subsequently in greater detail, is to provide new and improved dowel board bow folding devices and method which has all the advantages of the prior art and none of the disadvantages.

To attain this, the present invention essentially comprises a new and improved dowel board bow folding device comprising, in combination: a base board fabricated of wood and formed in a planar generally rectangular configuration with an upper surface and a lower surface, the apparatus having parallel long side edges and parallel short side edges, the approximate center point of the board having a generally circular shaped aperture extending therethrough, a thin generally rectangular shaped channel extending from the approximate center point of a first long side edge through to the central aperture, the upper surface of the board having a series of eleven bore holes, a first large central bore hole having its center point positioned along the rectangular channel a short distance from the first side edge, the central bore being approximately the same size as the central aperture and extending half way through the thickness of the board, the board having five bore holes positioned at either side of the central bore, each of the side bore holes having a much smaller diameter than the central bore hole, each set of five bore holes being positioned in an angled orientation away from the central bore hole, the first of each series of five bore holes being positioned with its center point in alignment with the center point of the large central bore hole, each remaining bore hole being positioned in an angled orientation toward the second long side edge and each respective short side edge, the bore hole being arranged in an angled orientation of approximately forty-five degrees with respect to each previous bore hole, the fifth and last bore hole of each series being positioned near the approximate center point of each short side edge; and the apparatus having a series of eleven dowels, a central dowel being the largest and having a diameter slightly less than the central bore hole, the cylindrical side edge of the central dowel having a generally rectangular shaped radial bore extending from one end through to the opposite end, the bore extending radially within the central dowel approximately one third of its diameter, the central dowel adapted to be positioned in the central bore hole of the base board with its radial bore positioned in alignment with the channel, the radial bore facing the central aperture of the board, the board having ten side dowels of equal size, each of the side dowels having a smaller diameter and the same height as the central dowel, each of the dowels adapted to be positioned in a side bore hole in the operative orientation, the central dowels and side dowels adapted to have ribbon or cloth positioned therearound for the purpose of making bows of various shapes, tiers and designs, the apparatus also including a standard clothes pin comprised of two planar generally rectangular shaped components with a tension spring positioned therebetween, the clothespin adapted to be positioned around any of the dowels for the purpose firmly securing the material which is to be formed into a bow.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved dowel board bow folding devices which have all the advantages of the prior art bow forming apparatuses and none of the disadvantages.

It is another object of the present invention to provide new and improved dowel board bow folding devices which may be easily and efficiently manufactured and marketed.

It is further object of the present invention to provide new and improved dowel board bow folding devices which are of durable and reliable constructions.

An even further object of the present invention is to provide new and improved dowel board bow folding devices which are susceptible of a low cost of manufacture with regard to both materials and labor, and which accordingly are then susceptible of low prices of sale to the consuming public, thereby making such dowel board bow folding devices economically available to the buying public.

Still yet another object of the present invention is to provide new and improved dowel board bow folding devices which provide in the apparatuses and methods of the prior art some of the advantages thereof, while simultaneously overcoming some of the disadvantages normally associated therewith.

Still another object of the present invention is to fashion bows of varying shapes and sizes by wrapping material around one or more dowels of the device.

Lastly, it is an object of the present invention to provide new and improved dowel board bow folding device comprising: a base board formed in a planar generally rectangular configuration, the upper surface of the board having a plurality of bore holes, a large central bore hole being positioned adjacent to a side edge of the board, the board having a plurality of bore holes positioned at either side of the central bore, each set of bore holes being positioned in an angled orientation away from the central bore hole; and a plurality of generally cylindrical shaped dowels, the dowels including a central dowel having a larger diameter than the plurality of side dowels, the central dowel adapted to be positioned in the central bore hole of the base board, the side dowels being of equal size, each side dowel adapted to be positioned in a side bore hole in the operative orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
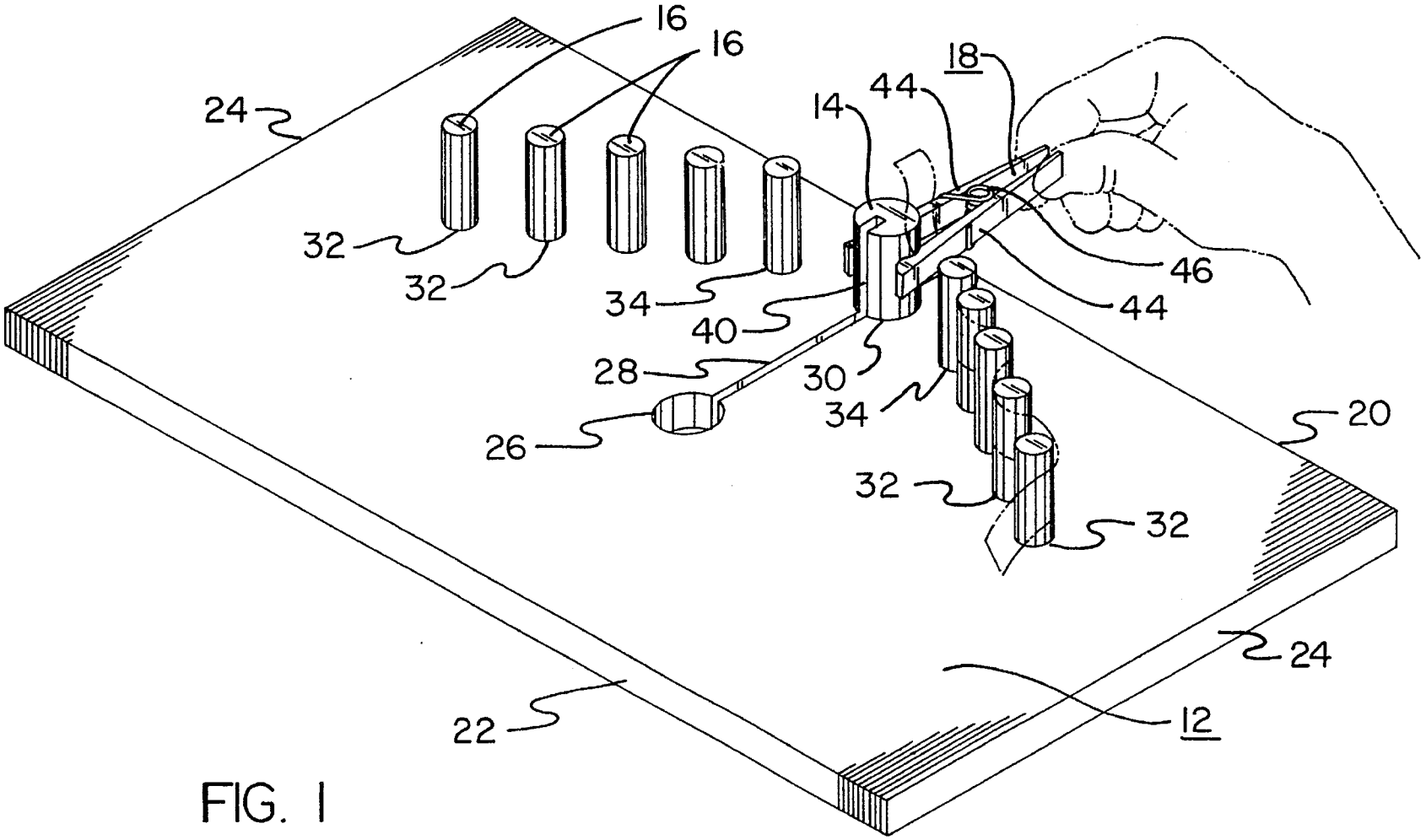
FIG. 1 is a perspective view of the preferred embodiment of the dowel board bow folding device constructed in accordance with the principles of the present invention.

With reference now to the drawings, and in particular to FIG. 1 thereof, the preferred embodiment of the new and improved dowel board bow folding devices embodying the principles and concepts of the present invention and generally designated by the reference numeral 10 will be described.

The present invention, the dowel board bow folding device 10 is comprised of a plurality of components. Such components in their broadest context include a base board 12, a central dowel 14, ten side dowels 16 and a clothes pin 18. Such components are individually configured and correlated with respect to each other so as to attain the desired objective.

More specifically, the base board 12 is fabricated of wood and formed in a planar generally rectangular configuration with an upper surface and a lower surface. The apparatus has parallel long side edges 20, 22 and parallel short side edges 24. The sturdy construction of the board helps prevent movement of the board during use. The approximate center point of the board has a generally circular shaped aperture 26 extending therethrough. A thin generally rectangular shaped channel 28 extends from the approximate center point of a first long side edge 20 through to the central aperture. A spool of ribbon or cloth may be placed in the central aperture and threaded through the channel in the operative orientation. Note FIG. 1.

Figure 2:
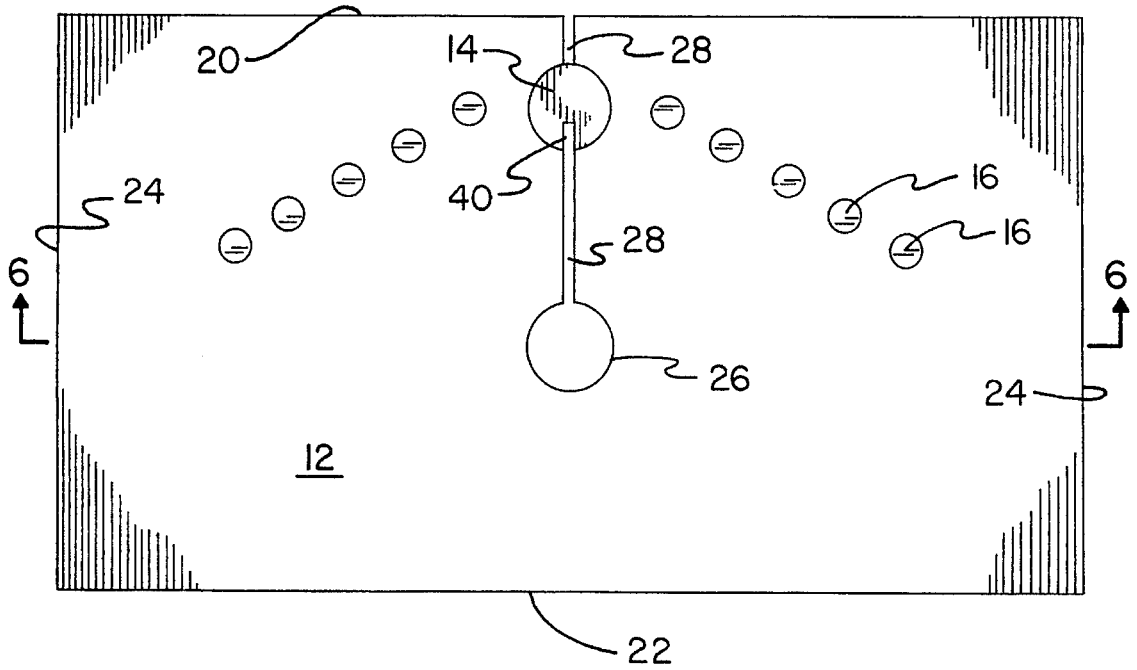
FIG. 2 is a top plan view of the apparatus shown in FIG. 1.
Figure 3:
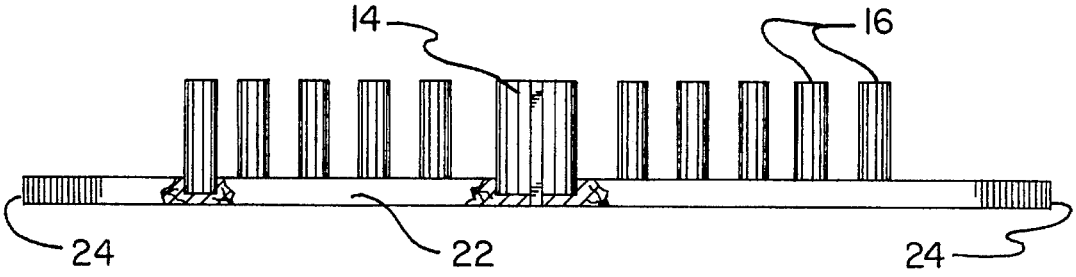
FIG. 3 is cross-sectional view of the apparatus taken along line 3—3 of FIG. 2.

The upper surface of the board has a series of eleven bore holes extending therewithin. A first large central bore hole 30 has its center point positioned along the rectangular channel a short distance from the first side edge. The central bore is approximately the same size as the central aperture and ,extends about one-half the way through the thickness of the board. The central aperture and central bore are connected by the channel. The board has five bore holes positioned at either side of the central bore. Each of the side bore holes 32 has a much smaller diameter than the central bore hole. The bore holes are adapted to firmly secure the dowels in the operative orientation. Note FIGS. 1, 2 and 3.

Each set of five bore holes is positioned in an angled orientation away from the central bore hole. The first 34 of each series of five bore holes is positioned with its center point in alignment with the center point of the large central bore hole. The alignment of the respective center points is parallel with the plane of the long side edges. Each remaining bore hole is positioned in an angled orientation toward the second long side edge 22 and each respective short side edge 24. The bore holes are arranged in an angled orientation of approximately forty-five degrees with respect to each previous bore hole. The fifth 36 and last bore hole of each series is positioned closest to the approximate center point of each short side edge. The orientation of the bore holes and central aperture resembles an arrow configuration when viewed from above. Note FIGS. 1 and 2.

Figure 6:
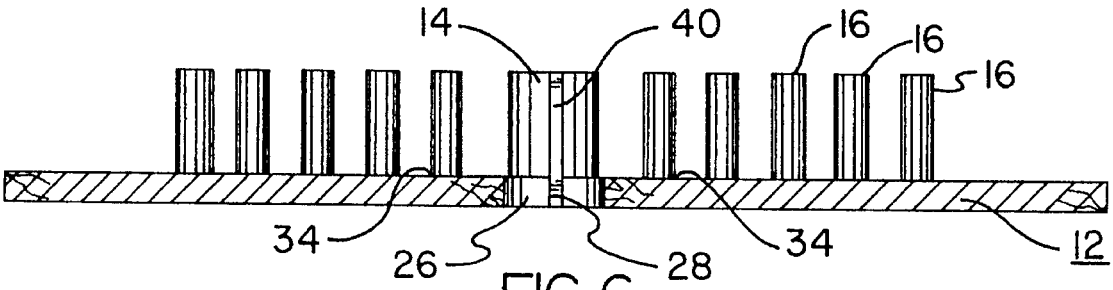
FIG. 6 is a cross-sectional view of the apparatus taken along line 6—6 of FIG. 2.
Figure 7:
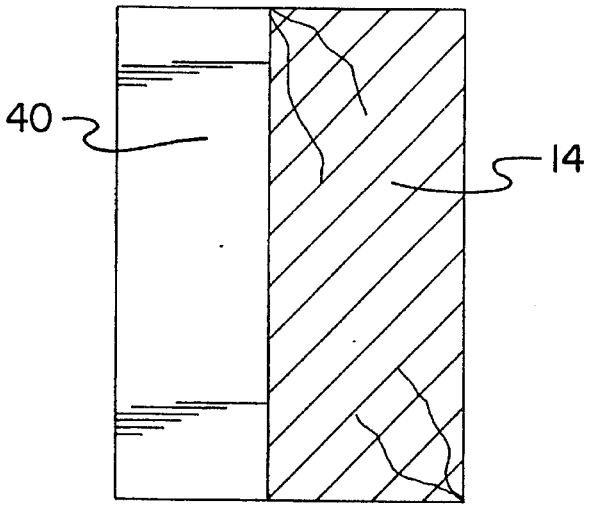
FIG. 7 is cross-sectional view of the central dowel of the apparatus taken along line 7—7 of FIG. 5.

The apparatus has a series of eleven dowels. Each dowel is formed in a long cylindrical configuration with two flat ends. A central dowel 14 is the largest and has a diameter slightly less than that of the central bore hole. Each of the dowels is positioned in its respective bore hole in a vertical orientation. The cylindrical side edge of the central dowel has a generally rectangular shaped radial bore 40 extending from one end through to the opposite end in a vertical orientation. Note FIGS. 6 and 7. The bore extends radially within the central dowel approximately one third of its diameter. The central dowel is adapted to be positioned in the central bore hole of the base board with its radial bore positioned in alignment with the channel. The radial bore faces the central aperture of the board. The channel extends through the central bore hole. The radial bore provides users with an excellent gripping surface to start the bow making procedure. Note FIGS. 1 and 6.

Figure 4:
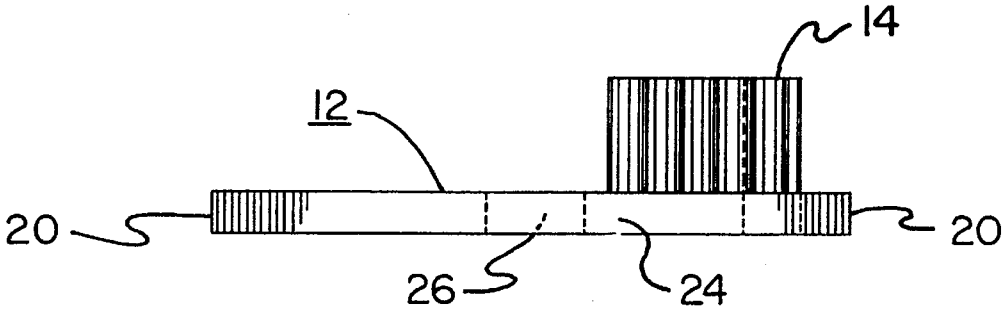
FIG. 4 is a cross-sectional view of the central dowel of the apparatus taken along line 4—4 of FIG. 3.
Figure 5:
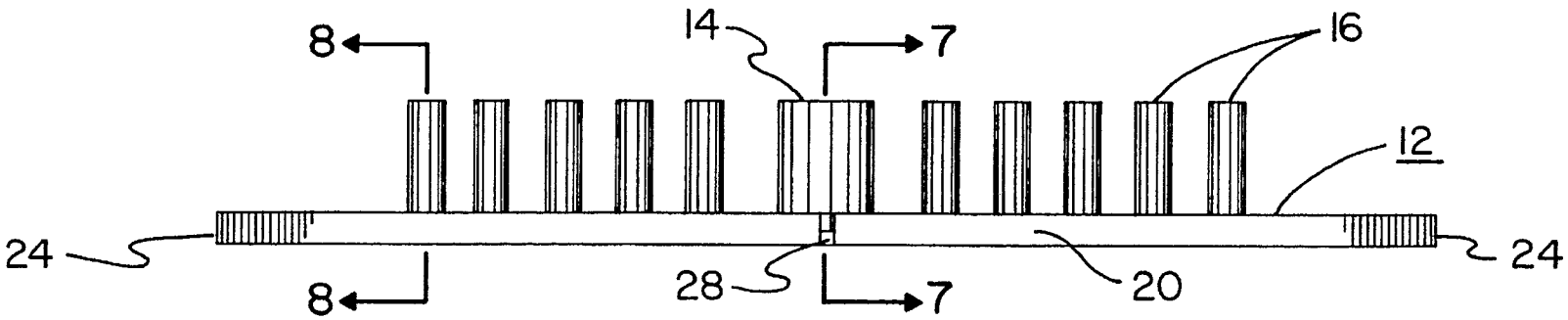
FIG. 5 is a rear elevational view of the dowel board bow folding device.
Figure 8:
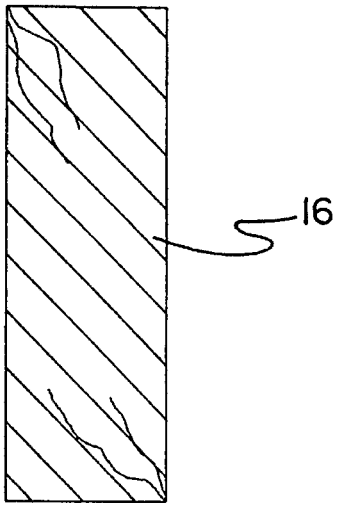
FIG. 8 is a cross-sectional view of a side dowel of the apparatus taken along line 8—8 of FIG. 5.

The board has ten side dowels 16 of equal size. Each of the side dowels has a smaller diameter and the same height as the central dowel. Each of the dowels is adapted to be positioned in a side bore hole in the operative orientation. Note FIG. 8. The configuration of the side dowels provides the user with a plethora of options with respect to making bows. The central dowels and side dowels are adapted to have ribbon or cloth positioned therearound for the purpose of fashioning bows of various shapes, tiers and designs. The central dowel provides an excellent starting spot for the construction of most types of bows. Note FIGS. 1, 4 and 5.

The apparatus also includes a standard clothes pin 18 comprised of two planar generally rectangular shaped components 44 with a tension spring 46 positioned therebetween. The clothes pin is adapted to be positioned around any of the dowels for the purpose of firmly securing the material which is to be formed into a bow. The clothes pin is particularly important when beginning the bow making procedure. Note FIGS. 1 and 6.

The dowel board bow folding device is an apparatus adapted to make various size bows. The dowels of the apparatus permit the user hands free operation. The device consists of a rectangular baseboard and a plurality of dowels. The device may be fabricated of wood, plastic or metal. A clothes pin is included with the apparatus. There are ten dowels of the same size and an eleventh dowel which is bigger in circumference than the others. The central dowel is mounted in the center of the base board near the first long side edge. The remaining side dowels are mounted on either side of the central dowel in a staggered placement. The side dowels descend down and away from the middle of the center dowel.

The bow maker can be used to make one to five tier bows. The apparatus is utilized in the following manner. Begin by attaching one end of the ribbon or lace to the central dowel with the clothespin. Next, start wrapping the ribbon or lace around the dowels, crossing back and forth to dowels on either side of the central dowel. For example, wrap the ribbon around the dowel to the left of the center dowel, carry it back across the central dowel, and wrap it around the dowel to the right of the central dowel. Depending on the type and size bow that is needed, the ribbon can be wrapped around only these two dowels many times or around each of the pairs of dowels in sequence. The apparatus is very easy to use, even for children. It leaves both hands free to tie off the bow when it is complete. The apparatus also makes bows that are always even.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved dowel board bow folding device comprising, in combination:

a base board fabricated of wood and formed in a planar generally rectangular configuration with an upper surface and a lower surface, the apparatus having parallel long side edges and parallel short side edges, the approximate center point of the board having a generally circular shaped aperture extending therethrough, a thin generally rectangular shaped channel extending from the approximate center point of a first long side edge through to the central aperture, the upper surface of the board having a series of eleven bore holes, a first large central bore hole having its center point positioned along the rectangular channel a short distance from the first side edge, the central bore being approximately the same size as the central aperture and extending half way through the thickness of the board, the board having five bore holes positioned at either side of the central bore, each of the side bore holes having a much smaller diameter than the central bore hole, each set of five bore holes being positioned in an angled orientation away from the central bore hole, the first of each series of five bore holes being positioned with its center point in alignment with the center point of the large central bore hole, each remaining bore hole being positioned in an angled orientation toward the second long side edge and each respective short side edge, the bore hole being arranged in an angled orientation of approximately forty-five degrees with respect to each previous bore hole, the fifth and last bore hole of each series being positioned near the approximate center point of each short side edge; and the apparatus having a series of eleven dowels, a central dowel being the largest and having a diameter slightly less than the central bore hole, the cylindrical side edge of the central dowel having a generally rectangular shaped radial bore extending from one end through to the opposite end, the bore extending radially within the central dowel approximately one third of its diameter, the central dowel adapted to be positioned in the central bore hole of the base board with its radial bore positioned in alignment with the channel, the radial bore facing the central aperture of the board, the board having ten side dowels of equal size, each of the side dowels having a smaller diameter and the same height as the central dowel, each of the dowels adapted to be positioned in a side bore hole in the operative orientation, the central dowels and side dowels adapted to have ribbon or cloth positioned therearound for the purpose of making bows of various shapes, tiers and designs, the apparatus also including a standard clothes pin comprised of two planar generally rectangular shaped components with a tension spring positioned therebetween, the clothespin adapted to be positioned around any of the dowels for the purpose of firmly securing the material which is to be formed into a bow.

2. A dowel board bow folding device comprising:

a base board formed in a planar generally rectangular configuration, the upper surface of the board having a plurality of bore holes, a large central bore hole being positioned adjacent to a side edge of the board, the board having a plurality of bore holes positioned at either side of the central bore, each set of bore holes being positioned in an angled orientation away from the central bore hole, the approximate center point of the board having a generally circular shaped aperture extending therethrough, the board including a thin generally rectangular shaped channel extending from the approximate center point of a long side edge through to the central aperture; and a plurality of generally cylindrical shaped dowels, the dowels including a central dowel having a larger diameter than the plurality of side dowels, the central dowel adapted to be positioned in the central bore hole of the base board, the side dowels being of equal size, each side dowel adapted to be positioned in a side bore hole in the operative orientation.

* * * * *